US007111600B2

(12) United States Patent
Naumann

(10) Patent No.: US 7,111,600 B2
(45) Date of Patent: Sep. 26, 2006

(54) VARIABLE VALVE-STROKE CONTROLS

(75) Inventor: Herbert Naumann, Elmshorn (DE)

(73) Assignee: ThyssenKrupp Automotive AG, Bochum (DE)

( * ) Notice: Subject to any disclaimer, the term of this patent is extended or adjusted under 35 U.S.C. 154(b) by 366 days.

(21) Appl. No.: 10/965,977

(22) Filed: Oct. 15, 2004

(65) Prior Publication Data

US 2005/0045126 A1 Mar. 3, 2005

Related U.S. Application Data

(62) Division of application No. 10/643,472, filed on Aug. 19, 2003, now Pat. No. 6,886,512.

(30) Foreign Application Priority Data

Jul. 17, 2001 (DE) ..... 101 36 612
Jul. 3, 2002 (EP) ..... PCT/EP02/07321

(51) Int. Cl.
*F01L 1/18* (2006.01)

(52) U.S. Cl. ..... 123/90.39; 123/90.16; 123/90.4

(58) Field of Classification Search ..... 123/90.16, 123/90.39, 90.4, 90.44, 90.45, 90.27, 90.31; 74/559, 567, 569
See application file for complete search history.

(56) References Cited

U.S. PATENT DOCUMENTS 5,899,180 A * 5/1999 Fischer ..... 123/90.16
6,439,177 B1 * 8/2002 Pierik ..... 123/90.16

* cited by examiner

*Primary Examiner*—Thomas Denion
*Assistant Examiner*—Ching Chang
(74) *Attorney, Agent, or Firm*—Max Fogiel

(57) ABSTRACT

Mechanical controls for continuously varying the length of the stroke of the valves in an internal-combustion engine and for maintaining the valves constantly closed while the engine is in operation while simultaneously varying how long the valve or valves remain open, whereby the valves are actuated by rocker levers that are in turn actuated by an angled lever, whereby the positions of the levers are varied in order to vary the length and duration of the stroke.

The valves are actuated at low engine speeds by assigning a specific narrow angle of rotation to each abbreviated stroke to be established.

FIG. 1 illustrates valve stroke controls with an angled lever (2) actuated by a cam (17) mounted on a lateral roller (3). In the event of a misalignment, a planetary gear comes into play, wherein a roller (9), mounted on the rocker lever (8) that actuates the valve (1) acts a sun wheel, the angled lever (2) acts as a planet wheel, and a setting lever (5) acts as a planet bearing.

12 Claims, 6 Drawing Sheets

VARIABLE VALVE-STROKE CONTROLS

BACKGROUND OF THE INVENTION

The present application is a divisional of the parent application Ser. No. 10/643,472, filed on Aug. 19, 2003, with claim of priorty of German application 101 36 612.4 file 17 Jul. 2001; and a 317 of PCT/EP02/07321 filed Jul. 3, 2002.

The present invention concerns mechanical controls that, during the operation of an internal combustion engine continuously vary the strokes of individual valves and groups of valves from maximally open to constantly closed, while simultaneously varying how long the valve or valves remain open. The valves are actuated by rocker levers that are in turn driven by subsidiary rocker levers, or by tilting or angled levers. The particular positioning of the subsidiary rocker tilting, or angled levers dictates the length and duration of the stroke. With the exception of one set, the valve-stroke controls allow actuation of the valves in the lower engine speed ranges. In accordance with manufacturers' specifications, once a shorter stroke has been selected, a considerably more acute angle of rotation for the open range of the valves and an angle even more acute in relation to the angle of rotation associated with valve opening will be available for the procedure of opening and closing the valves.

With the exception of further valve-stroke controls, only a little shift in the valve actuation phasing, if any, occurs.

These controls cam be employed for controlling valves without throttling and for valve-and-cylinder turnoff.

Furthermore, valves can be alternately actuated with these controls by using different cams, the shift resulting from the adjustment of control levers and without using switchover coupling bolts. Accessories can be employed to extend maintenance intervals.

These controls feature characteristics of the controls disclosed in Patent Application 100 36 373.3-13, the priority of which is hereby claimed.

SUMMARY OF THE INVENTION

DESCRIPTION OF THE PREFERRED EMBODIMENTS

Figure 1:
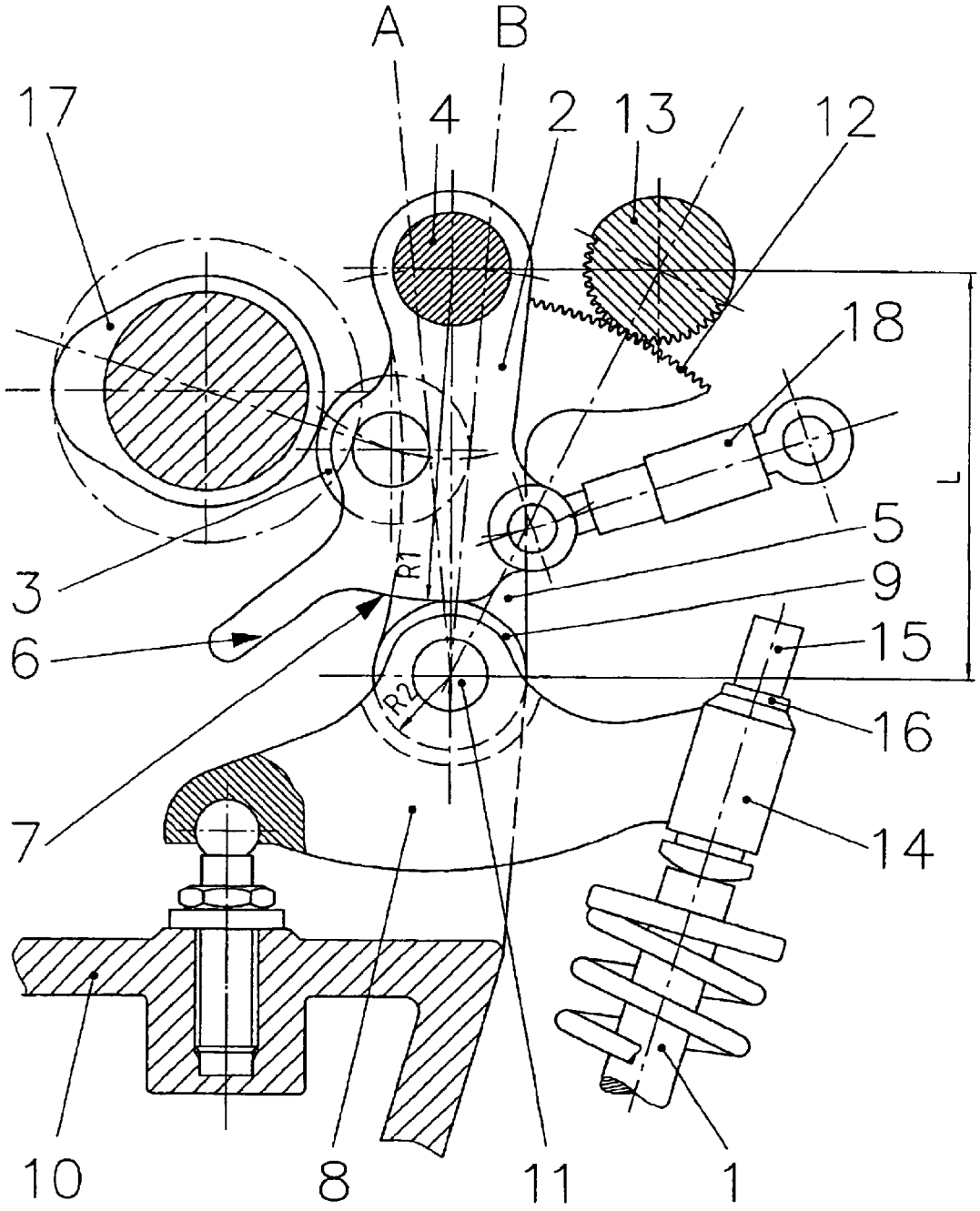
FIG. 1 illustrates valve-stroke controls with an angled lever, actuated by a lateral roller, whereby adjustment involves the action of a planetary gear with rollers on the rocker lever that actuates the valves acting on a sun wheel, the angled lever acting as a planet wheel, and the setting lever acting as a planet carrier.

FIG. 1 illustrates valve-stroke controls accommodated in a cylinder head for the purpose of actuating a valve 1. A more or less upright angled lever 2 driven by a revolving cam 3 mounted at one edge. One angled-lever setting lever 5 is mounted on each side of angled lever 2 and acts as an accommodation for the swivel 4 that angled lever is mounted in. Angled lever 2 is provided with two structures 6 and 7 that project downward at more or less of a right angle to the longitudinal axis of angled lever 2. Structure 6 actuates a rocker lever that actuates valve 1 by way of a roller 9. Structure 7 on the other hand maintains the valve constantly closed.

These valve-stroke controls continuously vary the stroke of the valve from maximally open to constantly closed, while the engine is in operation, but the duration decreases with the length of the stroke. Only a slight phase shift of the valve actuation is possible.

The valve-stroke controls in accordance with the present invention operate on the same principle as a planetary gear, a roller 9 on the swiveling gear representing the sun wheel ad angled lever 3 exercising the function of planet wheel.

Structure 7 has a positively circular curvature and constitutes the roll-over surface of a planet wheel. Angled-levers setting levers 5 act as planet mounts and are provided with a swivel 11 that swivels on cylinder head 10 around the same axis as the "sun" roller 9 on rocker lever 8 as long as valve 1 remains closed. When angled-lever setting levers 5 pivot, accordingly, angled-lever 2 pivots along the circumference of a circle around swivel 11 and hence around the shaft of rollers 9. When, on the other hand, angled lever 2 pivots, valve 1 is not actuated and its "play" is unaffected as long as the circular structure 7 engages the circumference of roller 9. In this situation, the distance L between the common axis of rotation of lower swivel 4 on levers 5 and rollers 9 and the one and the axis of rotation of the upper common swivel 4 on levers 5 and angled lever 2 on the other will be the total of radius R1 of curvature of structure 7 and the radius R2 of roller 9: L=R1+R2 when, subsequent to an adjustment on the part of setting levers 5, negative structure 6 engages the circumference of roller 9, rocker lever 8 will initially be actuated with only a brief rocking motion around an acute angle of rotation, whereby, as the structure continues to engage the circumference of the roller, the rocking motion and angle of the rocking lever will increase.

For purposes of adjustment, setting lever or setting levers 5 are provided with a contour in the form of an arc of a circle provided with cogs and extending around the axis of rotation of swivel 11, which is engaged by a driveshaft 13 with matching cogs. The two setting levers, however, can also be driven by an articulated rod subject to an eccentric shaft or crankshaft.

In State A, the controls are set for maximal valve stroke and, in State B, to maintain valves 1 closed. Two valves can be actuated simultaneously, and two angled levers 2 can be employed, one on each side of a setting lever 5, every angled lever driving a rocker lever that actuates a valve 1.

The end of the rocker lever 8 that actuates a valve 1 is provided with a valve-play compensator 14, its upward motion limited by an appropriately positioned adjustable counterbearing 15. Counterbearing 15 is fastened to the cylinder head and provided with a dashpot. The position of counterbearing 15 allows the controls to function normally even when the upper surface of valve 1 is hit by a valve head and raised. In this event, counterbearing 15 will maintain the engagement between angled lever 4 and the roller 9 on rocker lever 8 unaffected, whereby any displacement of valve 1 will be compensated by compensator 14.

Since cams 17 can drive angled lever 2 in only one direction, it must be driven in the opposite direction by a resetting component 18 that forces roller 3 against cams 17.

Figure 2:
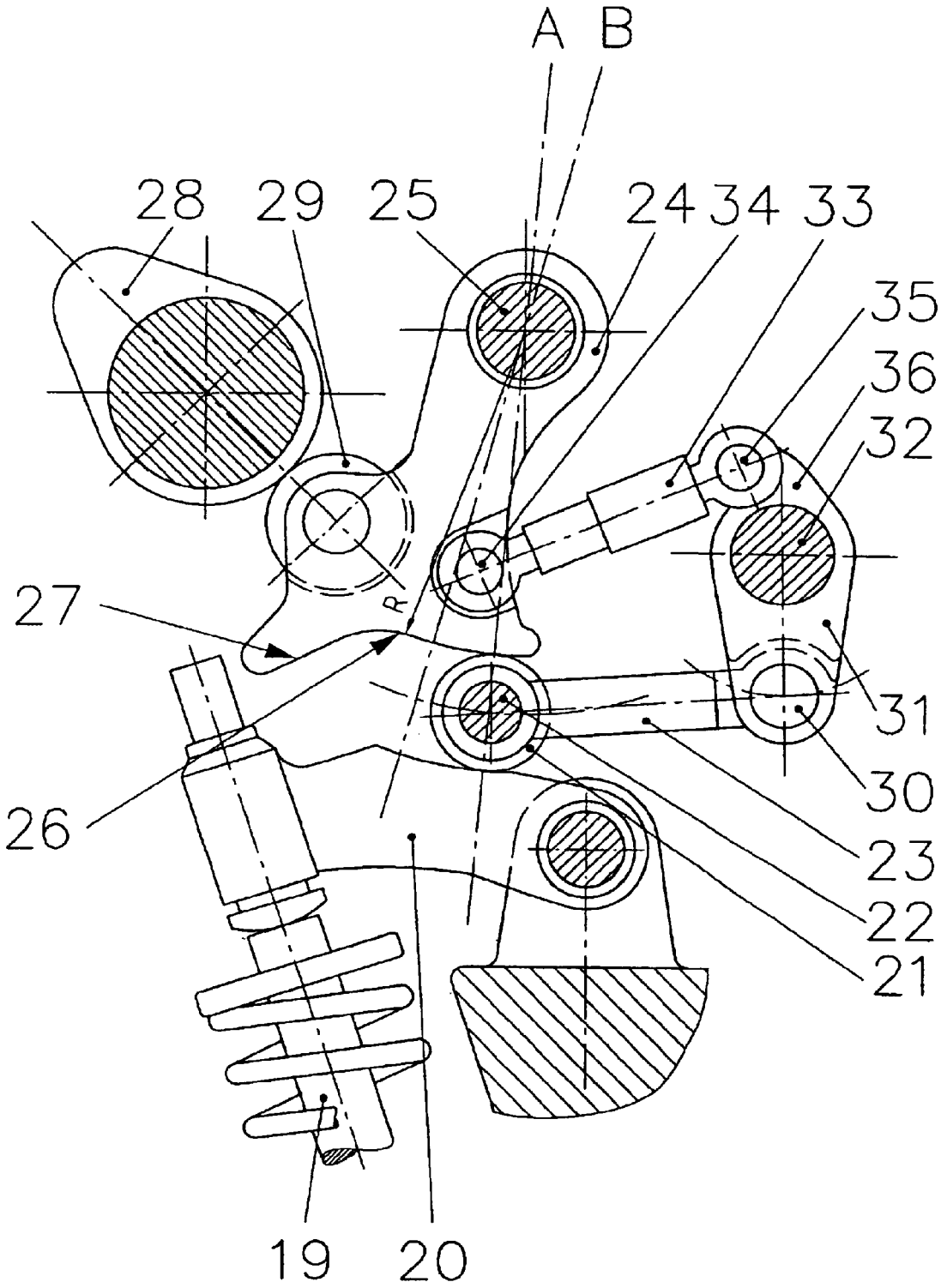
FIG. 2 illustrates valve-stroke controls with an angled lever laterally actuated by a cam that, by way of rollers fastened to an adjustable articulated rod, drives rocker levers that actuate valves.

FIG. 2 illustrates valve-stroke controls accommodated in a cylinder head and intended for the simultaneous actuation of two valves 19. Each of the two rocker levers 20 is driven by a single roller 21 at the top. Rollers 21 are mounted on the same axis 17. Axis 22 is secured to the fork uprights of a longitudinally variable articulated rod 23. Another roller 21 rotates between the others and between the fork uprights.

A more or less upright angled lever 24 is positioned above middle roller 21 and laterally driven by a cam 28 mounted on a roller 29. The upper end of angled lever rotates on a swivel 25 integrated into the cylinder head. The lower end of the lever is provided with structures 26 and 27 that extend at more or less a right angle to its longitudinal axis and engage middle roller 21. Structure 26 is responsible for maintaining valve 19 constantly closed and its contour is in the form of a positive circular arc.

The radius R of the arc exhibits a center located in the axis of rotation of swivel 25. Adjacent to structure 26, structure 27, in the form of a negative curve, is responsible for generating a valve stroke. Articulated rod 23 is accommodated in a swivel 30 in a setting lever 31 driven by a driveshaft 32, and the controls are adjusted by displacing articulated rod 23 over structures 26 and 27.

These controls make it possible to continuously vary the length of the valve stroke while the engine is in operation from a maximum to constantly closed, whereby the time during which the valve remains open decreases with the length of the stroke.

There is no phase shift.

At angular State A, the valve-stroke controls are set for maximal stroke and, at State B, for maintaining valves 19 constantly closed.

When only one valve 19 is to be actuated, angled lever 24 drives middle roller 21, while rocker lever 20 is simultaneously driven by the outer rollers 21. The middle roller has a shorter diameter, preventing torque on articulated rod 23. It is alternatively possible for the two outer rollers 21 to be driven by angled levers 24, with the middle roller driven by angled lever 24 (sic).

Cams 28 can drive angled lever 24 in one direction, and it is driven in the other direction by a resetting mechanism 33 that forces the lever and its roller 29 against cam 28. Resetting mechanism 33 is fastened to angled lever 24 by a swivel 34 and at a swivel 35 to a lever 36 connected to setting lever 31 such that, when the controls are adjusted for a shorter stroke, the restoring force of resetting mechanism 33 will simultaneously increase.

Figure 3:
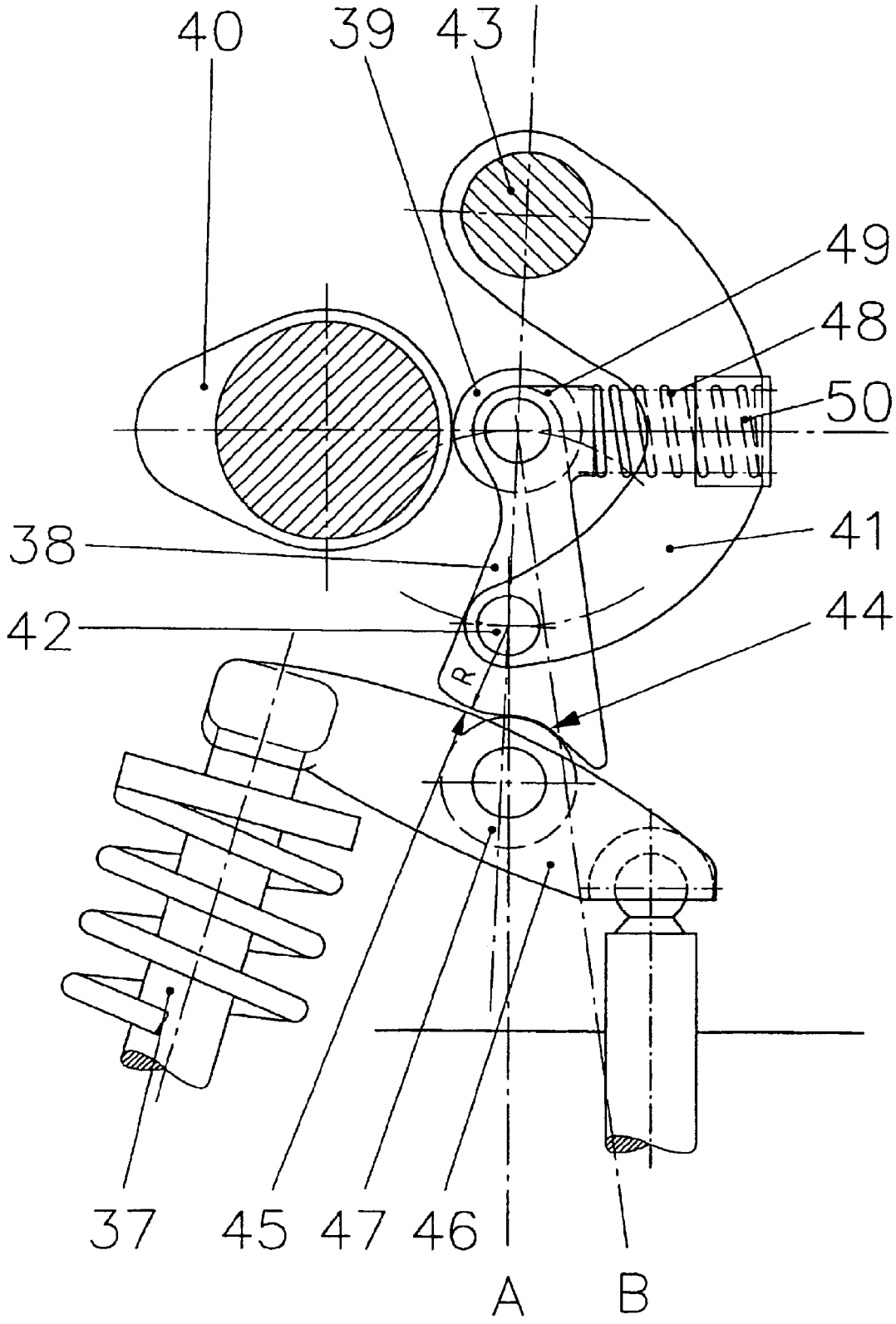
FIG. 3 illustrates valve-stroke controls with an angled lever driven by a lateral cam that is articulated to a setting lever such that the lever will execute the motion of a tilting lever, deiving a rocker lever that actuates a valve.

FIG. 3 illustrates valve-stroke controls accommodated in a cylinder head and intended for actuating a valve 37. A more or less upright angled lever 38 is driven at the top by a cam 40 mounted on a lateral roller 34. There is a setting lever 41 on each side of angled lever 38, acting as an accommodation for a swivel 42 in angled lever 38. Swivel 42 is located at the bottom of lever 38. Setting lever 41 rotates along with a driveshaft 43 in the cylinder head.

The angled lever 38 in accordance with the present invention operates on the principle of a tilting lever, whereby, however, the lever, in order to actuate a valve 37, is provided with structures 42 and 45 that extend down at more or less a right angle to its longitudinal axis, with structure 44 driving a rocker lever 46 by way of its roller 47. Engagement on the part of structure 45 with roller 47 on the other hand maintains valve 37 constantly closed. Structure 47 is in the form of a positively circular arc, its radius R being provided with a center along the axis of rotation of angled lever 38.

These valve-stroke controls can continuously vary the length of a stroke from maximum to constantly closed while the engine is in operation, whereby the length of time the valve remains open decreases with the length of the stroke.

The phase shift is only slight.

In State A, the controls are adjusted for maximal stroke length and, in State B, for maintaining valve 31 constantly closed.

Cam 40 can drive angled lever 38 in only one direction, and it must be driven in the other direction by a resetting mechanism 48 that forces angled lever 38 and its roller 38 against cam 40. Resetting mechanism 38 is connected on the one hand to angled lever 38 by a swivel and on the other accommodated in the swivel 49 common to the two setting levers 41.

Figure 4:
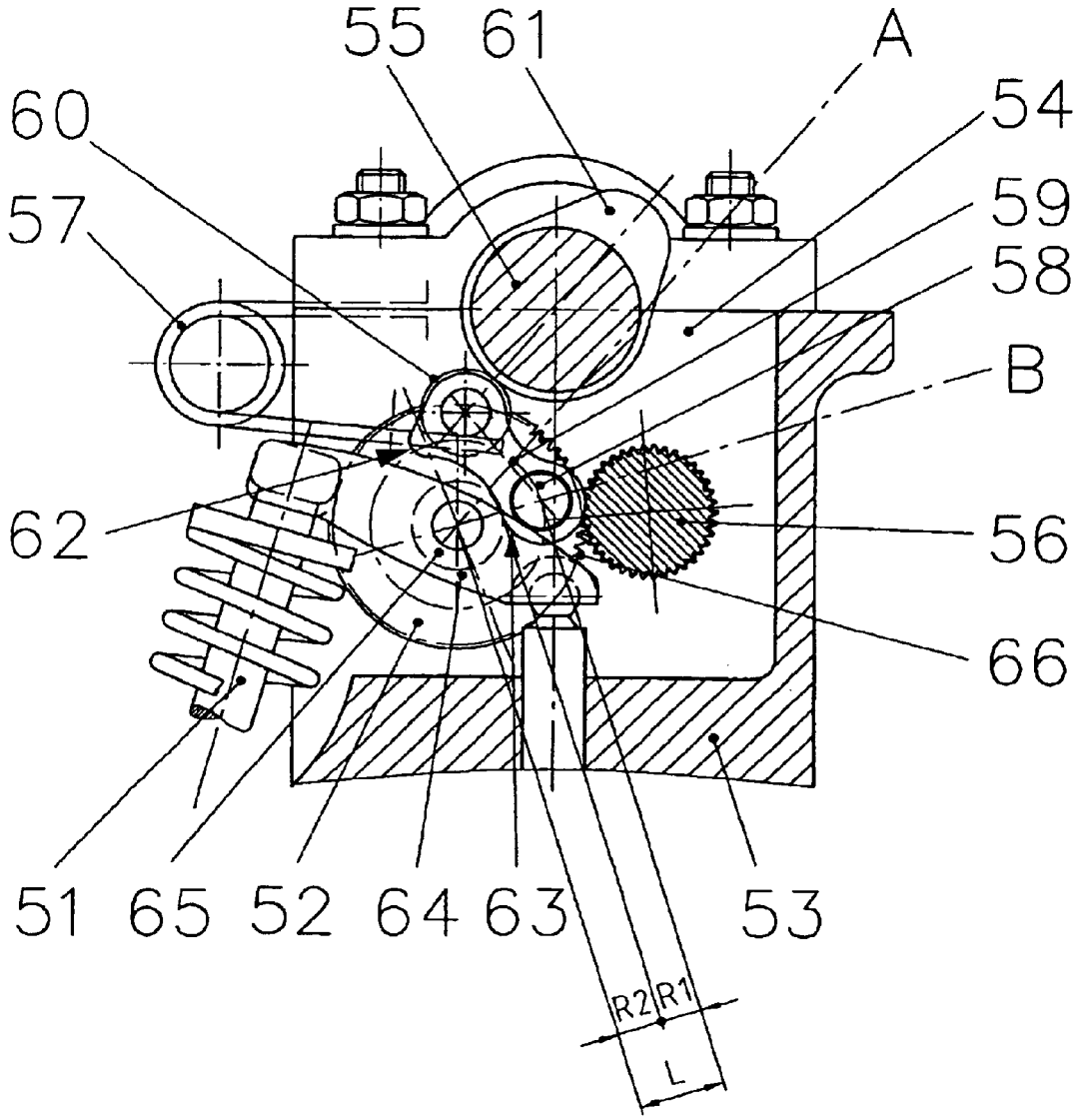
FIG. 4 illustrates valve-stroke controls with two rocker levers, one on each side of a setting lever and each being driven by a cam and driving a rocker lever that actuates a valve.

FIG. 4 illustrates valve-stroke controls accommodated in a cylinder head and intended for actuating two valves 51 simultaneously. The controls in accordance with the present invention are provided with a setting disk 52 that rotates in a bearing block 54 fastened to a cylinder head 53. Bearing block 54 also acts on a bearing for accommodating a camshaft 55 and a driveshaft 56 and as a holder for recuperating springs 51. Setting disk 52 has an axis 58 at one side. On each side of the setting disk is a rocker lever 59. Each rocker lever 59 is driven by a separate cam 61 mounted on a roller at the top. Rocker levers 59 are provided with downward directed structures 62 and 63 that more or less parallel the longitudinal axis of rocker lever 59. Each structure 62 drives a rocker lever 64 by way of its roller 65, whereas structures 63 maintain valves 61 constantly closed.

These valve-stroke controls can continuously vary the length of a stroke between a maximum and constant closure. The duration that a valve is open decreases with the valve stroke. The valve actuation is subject to phase shift, the replacement of one camshaft adjustment mechanism if the camshaft is rotating in the right sense.

These controls operate on the principle of a planetary gear, the rollers 65 associated with the two valves executing the function of a sun wheel, rocker lever 64 that of a planetary wheel, and the positively circular arc the rollover edge of a planet wheel.

Setting disk 52 acts as a planet carrier, its axis of rotation simultaneously being the axis of rotation of the rollers that act as a sun wheel when valves 51 are closed. Thus, as setting disk 52 turns, rocker lever 59, mounted on axis 58, will move in a circle around the axis common roller 65 and setting disk 52, whereby during the rocking motion of rocker lever 59, valves 51 will not be actuated, and the valve play will remain unaffected as long as positively circular structure 63 engages the circumference of roller 65. Structures 63, which maintain valves 51 constantly closed, are in the form of positive circular arcs with a radius R1. The center of the circle is along the axis of rocker lever 59. Radius R1 plus the Radius R2 of rollers 65 are as long as the distance L between the common axis of setting disk 52 and rollers 65 on the one hand and the axis 58 of setting disk 52. Once setting disk 52 has turned and negative structures 62 have come into engagement with the circumference of rollers 65, rocker lever will be driven, initially around an acute angle, whereas, on the other hand, as the structures continue to engage the rollers, the rocking motion will increase along the angle.

The circumference of setting disk 52 is provided with cogs 66 that extend along it in a circle. These cogs are engaged by the cogs around the driveshaft that rotate in bearing block 54.

In State A, the controls are set for maximal stroke and, in State B for constantly closed valves 52.

One valve 51 or three valves 52 simultaneously can be actuated by two setting disks 52. A rocker lever 59 driven by a cam 61 is mounted between the setting disks 52 on an axis 58 that extends between the setting disks. To actuate three valves 51 simultaneously, another rocker lever 59 driven by a cam 61 is mounted outside setting disks 52 on an axis 58 extending out of the disks. All rocker levers 59 actuate their valves 51 by way of their associated rocker levers 64.

Since cams 61 drive rocker levers 59 in only one direction, they must be shifted in the other direction by recuperators in the form of rotary springs 57 that force rocker levers 59 and its associated roller 60 against cams 61.

The shanks of the springs, to simplify their installation and assembly, are inserted into and clamped in the impact range of the divided bearing for camshaft 55 in bearing block 54.

Due to rocker levers 58, adjacent and oppositely oriented on various axes 58 of setting disks 52, valves 51 can be actuated by different cams 61. Rocker levers 59 are mounted on setting disk 52 on at least two axes 58 such that a rotation on the part of the setting disk group of rocker lever 59 pointing in one sense of rotation will move into the range of engagement with the cams, whereas another group, pointing in the other direction, will simultaneously move out of the range.

Figure 5:
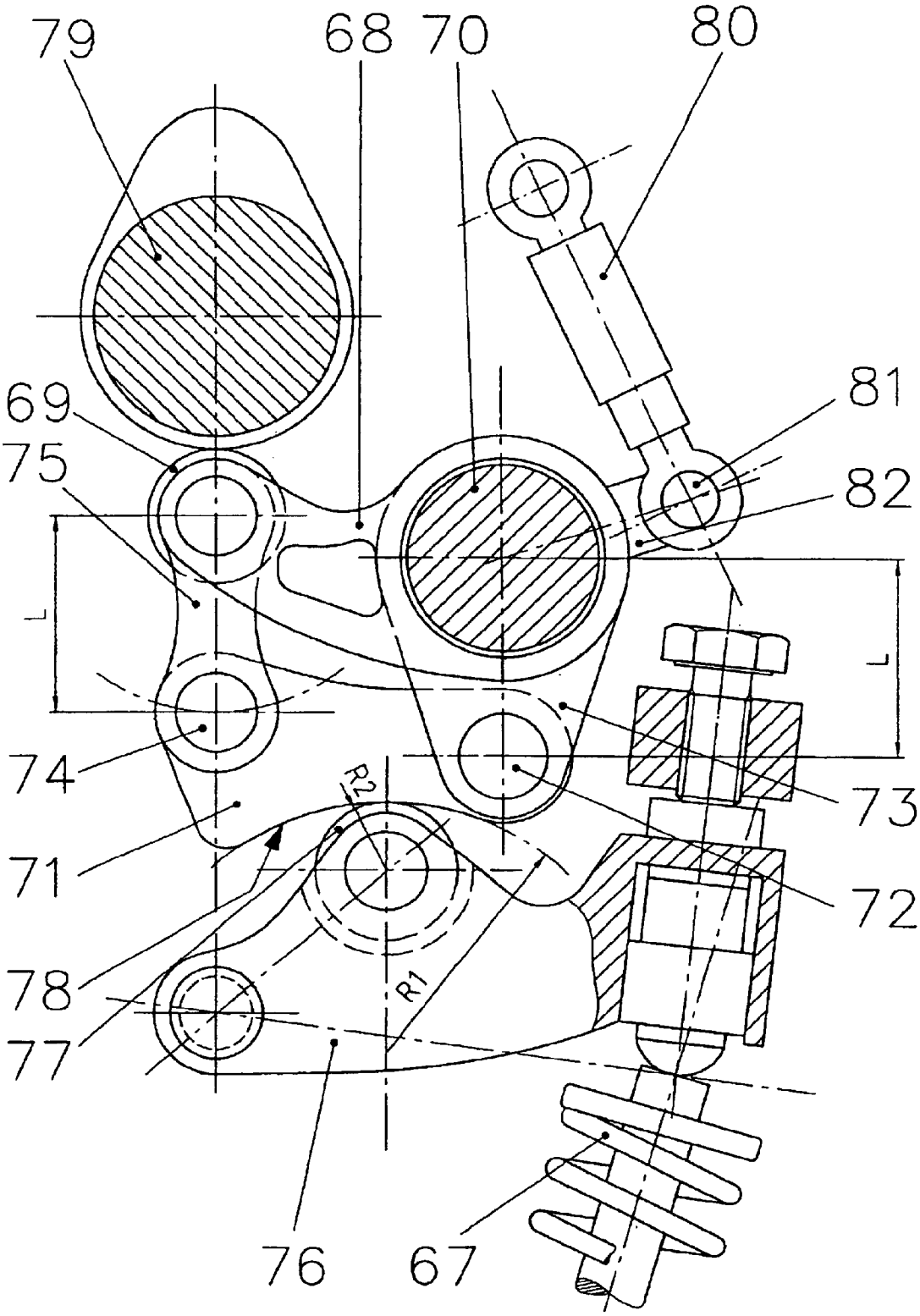
FIG. 5 illustrates valve-stroke controls wherein the cammed roller is fastened to a horizontal steering lever, preventing a phase shift in valve actuation while the controls are being adjusted.

FIG. 5 illustrates valve-stroke controls accommodated in a cylinder head and intended for actuating a valve 67. Resetting of the controls does not result in any valve-actuation phase shift. The controls in accordance with the present invention are provided with a cammed roller 69 mounted on a more or less horizontal driving rod 68. Driving rod 68 rotates around a control shaft 70. Below and paralleling driving rod 68 is a rocker lever 71. Rocker lever 71 is mounted at one end in a swivel 72 that is part of a setting lever 73 that rotates along with control shaft 70. At its other end, rocker lever 71 is mounted in a swivel 74 in a predominantly perpendicular articulated rod 75 connected to the axis of cammed roller 69. Below rocker lever 71 is another rocker lever 78 that is provided with a roller 77. Upwards, roller 77 engages a structure 78 in the form of a negative circular arc on rocker lever 71. The distance L between the axis of rotation of roller 69 and that of swivel 74 equals the distance between the axis of rotation of control shaft 70 and that of swivel 72. The radius R1 of the downward facing structure 78 on rocker lever 71 equals the distance L plus the radius R2 of the roller 77 on rocker lever 76—R1=L*R2.

Since cam 79 can be driven in only one direction, driving rod 68 and rocker lever 71 plus articulated rod 75 must be driven in the opposite direction by a resetting component 80. Resetting component 80 is connected to the cylinder head at one end and, at the other, by way of a swivel 81 that is part of a lever 82 connected to driving rod 68, forcing roller 69 against cam 79.

Figure 6:
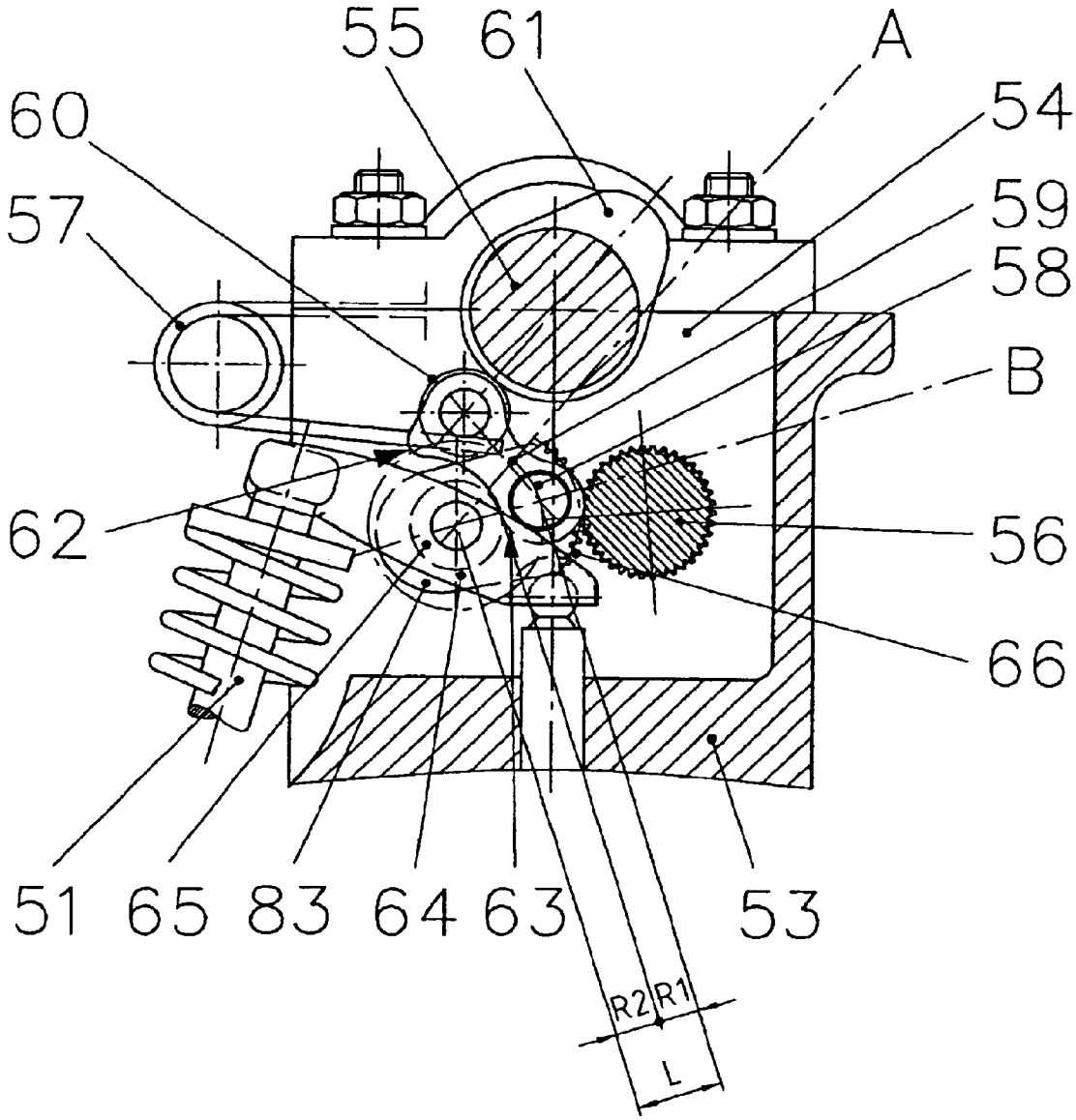
FIG. 6 is a sectional view of another embodiment of FIG. 4.

The controls illustrated in FIG. 4 also make it possible to employ as a setting component a setting lever 83 as represented in FIG. 6 instead of the setting disk 52 hereintofore specified. The axis of rotation of setting lever 83 must, as with setting disk 52, align with the axis of rotation of roller 65 when its associated valve 51 is closed. Setting lever 83 can be in the form of an angled lever, in which case it will be provided with, remote from its axis of rotation, an axially parallel pivoting accommodation with an axis 58 for a rocker lever 59. In this event, setting lever 83 will perform the function of setting disk 52.

Either setting disk 52 or setting lever 83 can be mounted on one side, or, overlapping the controls, on both sides. Setting lever 83 can be turned indirectly by way of a control shaft 56 as depicted in FIG. 6 or directly.

What is claimed is:

1. Valve-stroke controls for continuously varying the length of the stroke of the valves in an internal-combustion engine and for maintaining the valves constantly closed while the engine is in operation with a substantially upright angled lever laterally actuated by a cam, whereby the lever has structures at the bottom that extend substantially down at a right angle to its longitudinal axis and engage the circumference of a roller mounted on a rocker lever that actuates a valve, characterized in that said levers and cam operate on the principle of a planetary gear, the angled lever executing the function of a planet wheel and being mounted at its upper end in a swivel between two setting levers that exercise the function of a planetary bearing, the setting levers themselves so mounted at their lower ends in a swivel on the cylinder head that the axis of rotation of the swivel is identical with that of the roller that executes the function of a sun wheel on the rocker lever that actuates the valve when the valve is closed, and whereby the structure that maintains the valve constantly closed is constituted by a roll-over surface of a planet wheel in the form of a positively circular arc, whereby the center of the radius of the circle coincides with the axis of rotation of the swivel and the distance between, and the sum of the radius of the arc and the radius of the roller equals the distance between the axis of rotation of the swivel on the angled lever and the common axis of rotation of the lower swivel on the setting levers and the roller.

2. Valve-stroke controls as in claim 1, characterized in that the setting lever employs for that function a cogged circular arc engaged by a cogged shaft, the radius of the first set of cogs constituting the center of the axis of rotation of the swivel.

3. Valve-stroke controls as in claim 1, characterized in that, to allow the actuation of two valves, one angled lever is mounted in the swivel on each side of a setting lever, each angled lever actuating a rocking lever that actuates a valve.

4. Valve-stroke controls as in claim 1, characterized in that the rocking lever that actuates the valve has a valve-play compensator on the end that actuates the valve, its upward motion limited by an adjustable counterbearing that is fastened to the cylinder head and provided with a rocker lever ensuring that the controls will function normally even when, say, one valve moves up subject to the impact of the valve seat.

5. Valve-stroke controls as in claims 1, characterized in that all the cammed and other rollers that actuate the valves are at least to some extent replaced by integrated low-friction structures.

6. Valve-stroke controls for continuously varying the length of the stroke and for maintaining the valve constantly closed while an internal-combustion engine is in operation, with a substantially upright angled lever, characterized in that the angled lever is accommodated at its upper end in a swivel fastened to the cylinder head, is actuated below the swivel by a cam mounted on a roller and by way of structures that extend down at substantially a right angle, and actuates from above a first roller mounted on a shaft, whereby the shaft is fastened to a longitudinally adjustable rod, another roller is positioned along the axis on each side of the first roller, and each of the other rollers forces down a rocker lever that actuates a valve.

7. Valve-stroke controls as in claim 6, characterized in that the structure that maintains the valves constantly closed is a positive circular arc, whereby its radius is provided with a center that lies along the axis of rotation of the swivel that is provided for the angled lever and fastened to the cylinder head.

8. Valve-stroke controls as in claim 6, characterized in that, when only one valve is to be actuated, the two other rollers simultaneously drive a rocker lever that actuates the valve and the diameter of the roller in the middle, the one actuated by the angled lever is shorter than those of the two outer rollers.

9. Valve-stroke controls as in claim 6, characterized in that, when only one valve is to be actuated, the two other rollers are driven by the angled lever and the roller between them drives the rocker lever that actuates the valves, and the diameter of the roller in the middle is longer than those of the two other rollers.

10. Valve-stroke controls as in claim 6, characterized in that the setting lever that drives the rod and is subject to a driveshaft is provided with a lever for fastening a re setting mechanism such that, when a short valve stroke is desired, the force of the resetting mechanism increases due to the simultaneously resulting tension of the re-setting mechanism.

11. Valve-stroke controls for continuously varying the stroke of a valve and for maintaining valves constantly closed in an internal combustion engine while the engine is in operation with a substantially upright angled lever characterized in that the angled lever is actuated at the top and from one side by a cam mounted on a roller and is provided with two structures that extend down substantially at a right angle to its longitudinal axis and actuate a roller on a rocker lever that actuates the valve, whereby the angled lever between its cammed roller and the downward-extending structures is accommodated in the swivel of two setting levers on each side of the angled lever, whereby the setting lever is rigidly attached by way of the roller to a driveshaft accommodated in the cylinder head.

12. Valve-stroke controls as in claim 11, characterized in that the structure on the angled lever that maintains the valve constantly closed is in the form of a positively circular arc with a radius with a center in the axis of rotation of the swivel employed by the angled levers.

* * * * *